US011286662B2

(12) United States Patent
Bartella et al.

(10) Patent No.: US 11,286,662 B2
(45) Date of Patent: Mar. 29, 2022

(54) FRAMED ACOUSTIC PANEL AND METHOD OF MANUFACTURE

(71) Applicant: CertainTeed Canada, Inc., Woodbridge (CA)

(72) Inventors: Luigi Bartella, Toronto (CA); Donald Deyoe, Newmarket (CA)

(73) Assignee: CertainTeed Canada, Inc., Toronto (CA)

( * ) Notice: Subject to any disclaimer, the term of this patent is extended or adjusted under 35 U.S.C. 154(b) by 0 days.

(21) Appl. No.: 16/799,446

(22) Filed: Feb. 24, 2020

(65) Prior Publication Data

US 2020/0270861 A1 Aug. 27, 2020

Related U.S. Application Data

(60) Provisional application No. 62/809,495, filed on Feb. 22, 2019.

(51) Int. Cl.
*E04B 1/86* (2006.01)
*E04B 9/04* (2006.01)
(Continued)

(52) U.S. Cl.
CPC ..... *E04B 1/86* (2013.01); *E04B 9/001* (2013.01); *E04B 9/0428* (2013.01);
(Continued)

(58) Field of Classification Search
CPC ..... E04B 9/0428; E04B 2001/8452; E04B 9/0435; E04B 1/86; E04B 9/001;
(Continued)

(56) References Cited

U.S. PATENT DOCUMENTS 3,479,770 A * 11/1969 Mock ..... A47B 95/04 49/501
3,546,842 A * 12/1970 Blum ..... E04B 9/12 52/506.07
(Continued)

FOREIGN PATENT DOCUMENTS

CN 107429515 A 12/2017
DE 9417293 U1 * 1/1995 ..... E06B 3/9644
(Continued)

*Primary Examiner* — Adriana Figueroa
(74) *Attorney, Agent, or Firm* — McDonnell Boehnen Hulbert & Berghoff LLP

(57) ABSTRACT

The present disclosure relates generally to acoustic panels, for example, suitable for acoustic ceiling surfaces. The present disclosure relates more particularly to acoustic panels that include a panel body (e.g., comprising fiberglass, or having an NRC value in the range of at least 0.5, e.g., 0.5-0.95 or 0.5-0.9) and a perimeter frame extending around a side edge of the panel body. The perimeter frame includes a plurality of frame members including a first frame member and a second frame member. A first adhesive bonds the frame members to the panel body. A second adhesive with a shorter working time may also bond the frame members to the panel body. In addition, or alternatively, a bracket that couples the frame members to one another includes a sharp projection that hinders removal of the bracket from the frame members once assembled. These aspects allow the acoustic panel to be handled before the first adhesive is cured.

21 Claims, 8 Drawing Sheets

(51) Int. Cl.
*E04B 9/00* (2006.01)
*E06B 3/964* (2006.01)
*E06B 3/968* (2006.01)
*E04B 1/84* (2006.01)

(52) U.S. Cl.
CPC ..... *E06B 3/9644* (2013.01); *E06B 3/9684* (2013.01); *E06B 3/9685* (2013.01); *E04B 2001/8452* (2013.01)

(58) Field of Classification Search
CPC .... E04B 9/0407; E06B 3/9644; E06B 3/9684; E06B 3/9685
See application file for complete search history.

(56) References Cited

U.S. PATENT DOCUMENTS 3,748,799 A * 7/1973 Tough ..... E04B 2/825 52/144
3,782,054 A * 1/1974 Goss, Jr. ..... E06B 3/9682 403/295
3,899,258 A * 8/1975 Matthews ..... E06B 3/9682 403/292
4,120,376 A * 10/1978 Palmer ..... E04B 1/8218 181/204
4,146,999 A * 4/1979 Petrovec ..... E04C 2/388 52/145
4,438,613 A 3/1984 Hintsa
4,548,010 A 10/1985 Hintsa
5,189,858 A 3/1993 Jouanet
5,428,930 A 7/1995 Bagley
6,499,262 B1 12/2002 Pinchot
8,424,251 B2 4/2013 Tinianov
8,763,342 B2 * 7/2014 Tseng ..... E06B 3/9645 52/656.9
2005/0086884 A1 4/2005 Langenhorst
2005/0126093 A1 6/2005 Wagner
2008/0047214 A1 2/2008 Gerkes
2008/0066394 A1 5/2008 Nielsen
2008/0230310 A1 9/2008 Kim
2014/0034588 A1 * 2/2014 Wang ..... E06B 3/9684 211/41.1
2017/0218995 A1 * 8/2017 Lesage ..... F16B 11/006
2019/0127972 A1 * 5/2019 Mackett ..... E04B 1/86

FOREIGN PATENT DOCUMENTS

FR 2094992 A5 * 2/1972 ..... E04B 1/5818
GB 2275061 A * 8/1994 ..... E06B 1/003
KR 20-1985-0008792 U 11/1985
WO 2012059757 A2 5/2012

* cited by examiner

FRAMED ACOUSTIC PANEL AND METHOD OF MANUFACTURE

CROSS-REFERENCE TO RELATED APPLICATIONS

This application claims the benefit of priority of U.S. Provisional Patent Application No. 62/809,495, filed Feb. 22, 2019, which is hereby incorporated herein by reference in its entirety.

BACKGROUND OF THE DISCLOSURE

1. Field of the Disclosure

The present disclosure relates generally to acoustic panels, for example, suitable for acoustic ceiling surfaces. The present disclosure relates more particularly to panels including a panel body (e.g., formed of fiberglass) supported by a perimeter frame attached to the outer edge of panel body.

2. Technical Background

Certain acoustic panels provide excellent acoustic performance. Accordingly, such panels are desirable for various construction products. For example, because of their ability to be manufactured with high noise reduction coefficients, acoustic panels make excellent ceiling panels. The panels can be secured to a ceiling grid and positioned adjacent to one another in order to form a continuous ceiling surface. Alternatively, the panels can be hung individually in certain areas of an indoor space in order to enhance the acoustic performance of the space.

A typical acoustic panel may include a body formed of a fiberglass material and a supporting frame that surrounds the fiberglass component. The frame can be composed of several frame elements that are secured to the fiberglass using an adhesive. The adhesive is applied between the fiberglass and the frame and allowed to set. Once the adhesive cures the acoustic panel is a robust structural element with excellent acoustic properties and an attractive aesthetic.

The present inventors have recognized that many adhesives that are advantageous for providing a durable and strong bond between the fiberglass (or other panel material) and the frame have long working times. As a result, after the panels are assembled they should be set aside to wait as the adhesive sets. Otherwise, unless the panels are handled with great care, the various components of the panels may begin to shift and require adjustment or reassembly. Thus, the present inventors have recognized that an acoustic panel that can be further processed and handled soon after assembly would be desirable to manufacturers.

SUMMARY OF THE DISCLOSURE

In one aspect, the present disclosure provides an acoustic panel comprising:

- a panel body (e.g., comprising fiberglass, or having an NRC value in the range of at least 0.5, e.g., 0.5-0.95 or 0.5-0.9), the panel body including an upper surface, a lower surface, and a side edge;
- a perimeter frame extending around the side edge of the panel body, the perimeter frame including a plurality of frame members comprising a first frame member and a second frame member;

- a first adhesive bonding a first portion of an inner surface of the first frame member to the side edge of the panel body; and
- a second adhesive bonding a second portion of the inner surface of the first frame member to the side edge of the panel body, the second adhesive having a substantially reduced working time compared to the first adhesive.

In another aspect, the disclosure provides an acoustic panel comprising:

- a panel body (e.g., comprising fiberglass, or having an NRC value in the range of at least 0.5, e.g., 0.5-0.95 or 0.5-0.9), the panel body including an upper surface, a lower surface, and a side edge;
- a perimeter frame extending around the side edge of the panel body, the perimeter frame including a plurality of frame members comprising a first frame member and a second frame member;
- a first adhesive bonding a first portion of an inner surface of the first frame member to the side edge of the panel body; and
- a bracket coupling the first frame member to the second frame member, the bracket comprising:
  - a first portion that is received in a slot in the first frame member, the first portion including a first laterally extending projection having a sharp edge that engages an inner surface of the slot in the first frame member so as to hinder removal of the bracket from the first frame member, and
  - a second portion that is received in a slot in the second frame member, the second portion including a second laterally extending projection having a sharp edge that engages an inner surface of the slot in the second frame member so as to hinder removal of the bracket from the second frame member.

In another aspect, the disclosure provides a method of manufacturing an acoustic panel according the disclosure, the method comprising:

- applying a first adhesive between a side edge of a panel body (e.g., comprising fiberglass, or having an NRC value in the range of at least 0.5, e.g., 0.5-0.95 or 0.5-0.9) and an inner surface of a first frame member of a perimeter frame;
- applying a second adhesive between the side edge of the panel body and the inner surface of the first frame member, wherein the second adhesive has a substantially reduced working time compared to the first adhesive; and
- securing the frame members of the perimeter frame around the side edge of the panel body.

In another aspect, the disclosure provides a method of manufacturing an acoustic panel according to the disclosure, the method comprising:

- applying a first adhesive between a side edge of a panel body (e.g., comprising fiberglass, or having an NRC value in the range of at least 0.5, e.g., 0.5-0.95 or 0.5-0.9), and an inner surface of a first frame member of a perimeter frame;
- coupling the first frame member to a second frame member of the perimeter frame using a bracket comprising:
  - a first portion that is received in a slot in the first frame member, the first portion including a first laterally extending projection having a sharp edge that engages an inner surface of the slot in the first frame member so as to hinder removal of the bracket from the first frame member, and a second portion that is received in a slot in the second frame member, the second portion including a second laterally extending projection having a sharp edge that engages an inner surface of the slot in the second frame member so as to hinder removal of the bracket from the second frame member; and securing the frame members of the perimeter frame around the side edge of the panel body.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional acoustic panels may be subject to relative movement between the components soon after assembly unless they are handled with great care. The present inventors have determined that an acoustic panel that can be further processed and handled soon after assembly would be desirable to manufacturers.

Accordingly, one aspect of the disclosure is an acoustic panel including a panel body and a perimeter frame. The panel body includes an upper surface, a lower surface, and a side edge. The perimeter frame extends around the side edge of the panel body and has a plurality of frame members including a first frame member and a second frame member. A first adhesive bonds a first portion of an inner surface of the first frame member to the side edge of the panel body and a second adhesive bonds a second portion of the inner surface of the first frame member to the side edge of the panel body. The second adhesive has a substantially reduced working time compared to the first adhesive.

Figure 1:
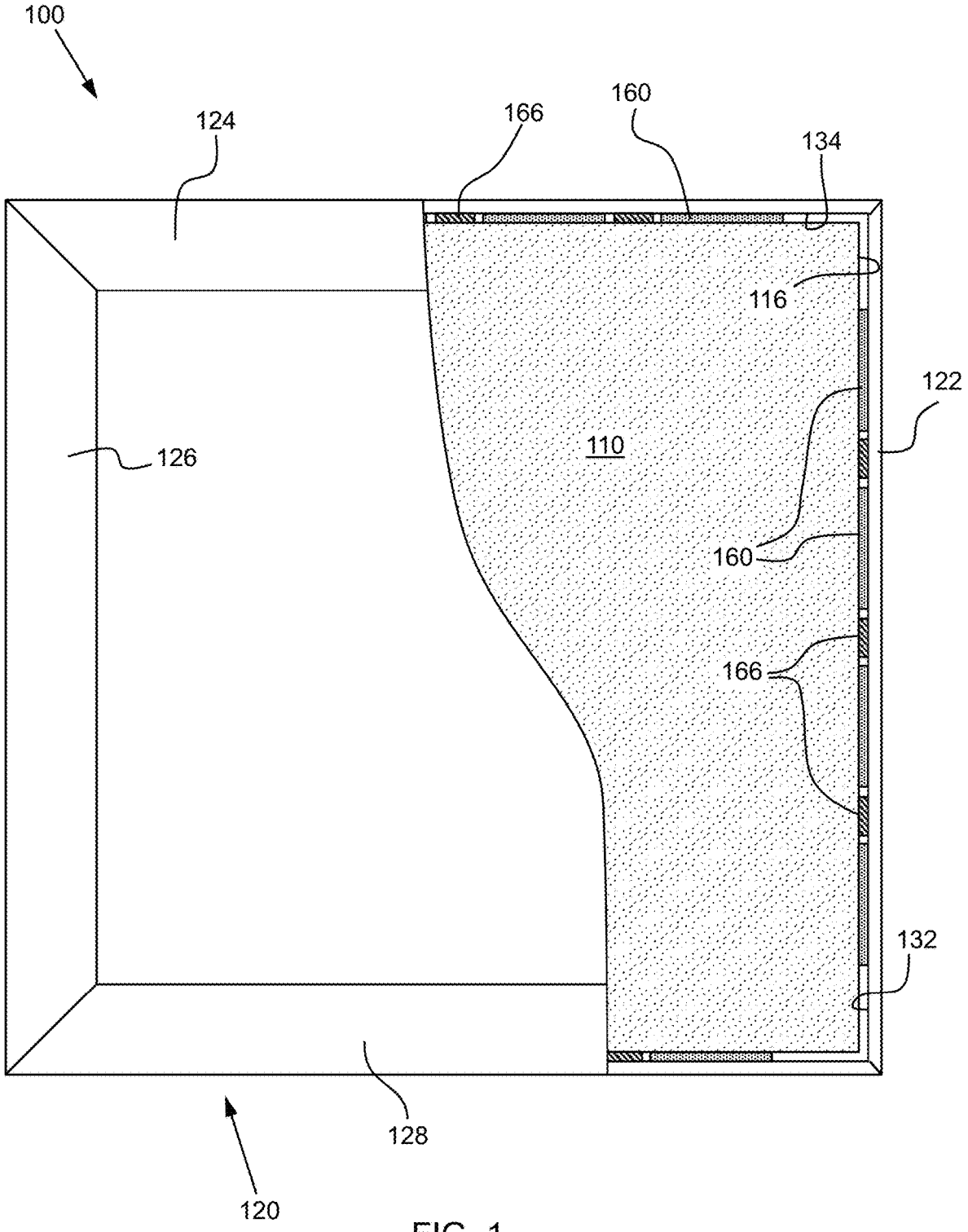
FIG. 1 is a schematic partial cross-sectional top view of an acoustic panel in accordance with an embodiment of the disclosure.
Figure 2:
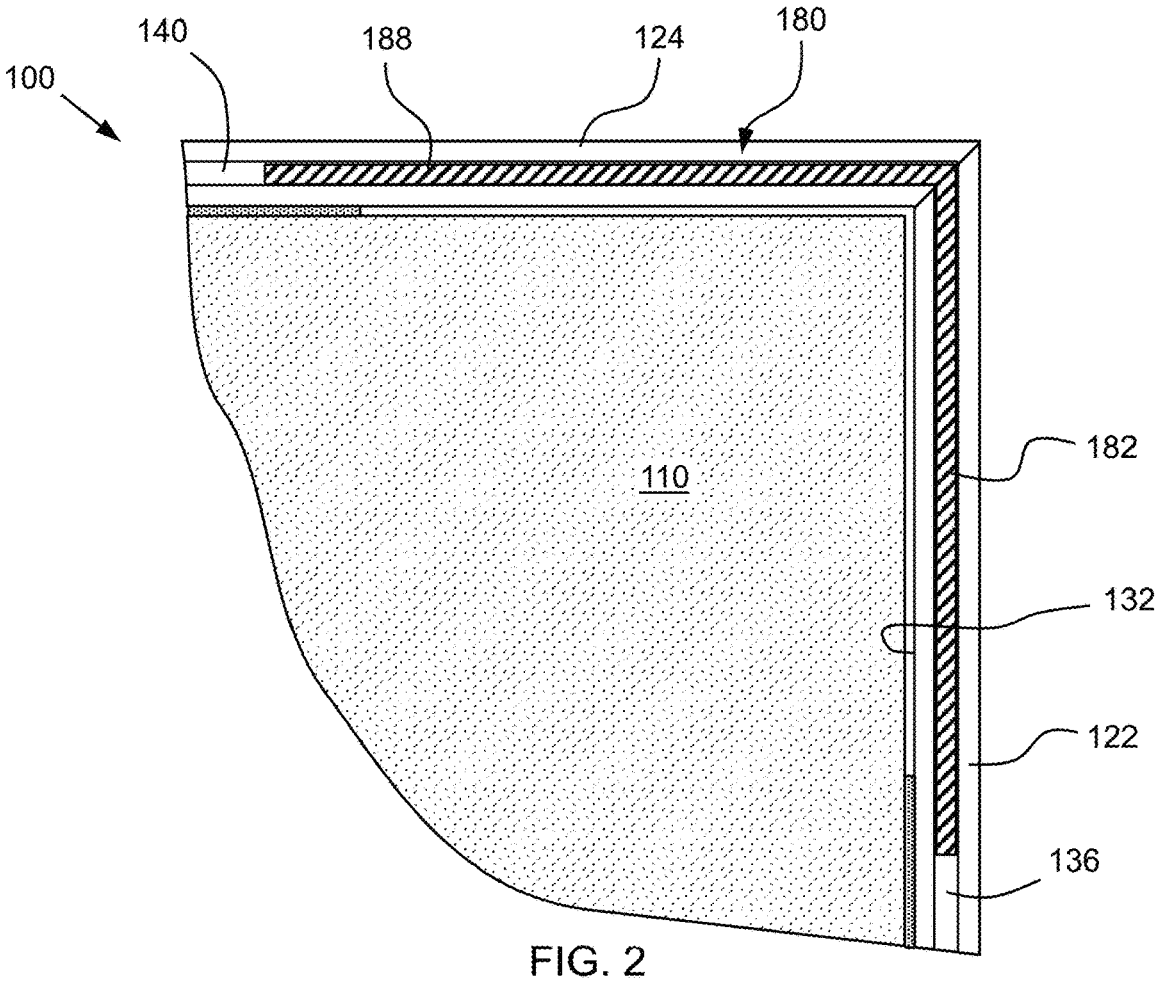
FIG. 2 is a detailed schematic cross-sectional top view of a portion of the acoustic panel of FIG. 1.
Figure 3:
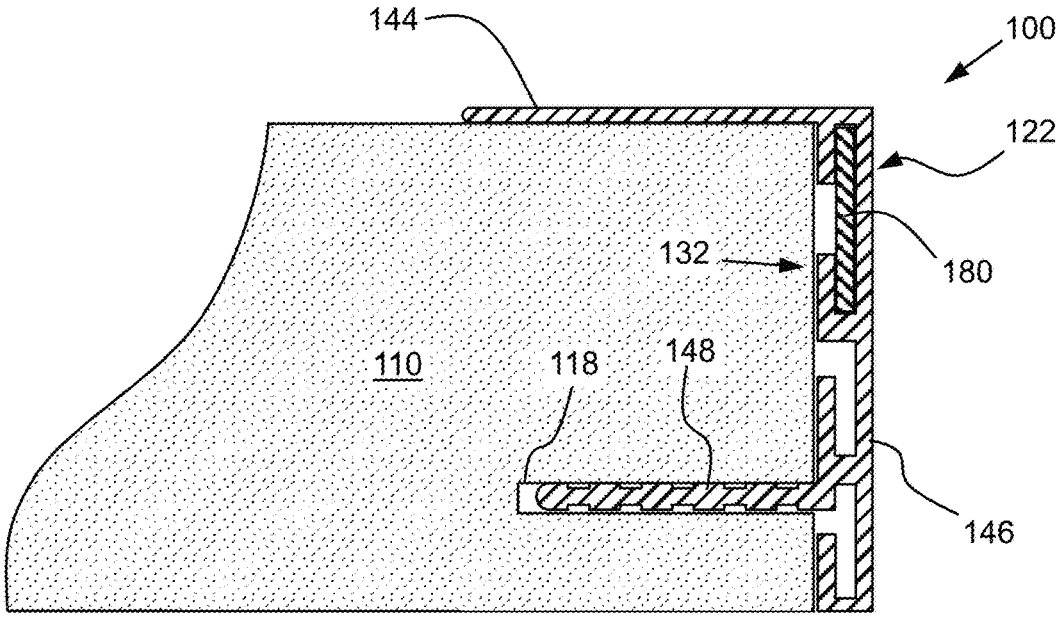
FIG. 3 is a schematic cross-sectional side view of a portion of the acoustic panel of FIG. 1

Such an acoustic panel is schematically shown in various views in FIGS. 1-3. Acoustic panel 100 includes a panel body 110, e.g., including a fiberglass material, or having an NRC value in the range of at least 0.5, e.g., 0.5-0.95 or 0.5-0.9. The panel body includes an upper surface 112, a lower surface 114, and a side edge 116 that extends around the circumference of panel body 110 (see FIG. 3). In acoustic panel 100, panel body 110 is formed as a rectangle and accordingly side edge 116 is formed by a number of planar sections about the circumference of panel body 110. In other embodiments, as described below, side edge 116 may be formed in more or fewer sections, including a single section in the case of a continuously curving edge.

The panel body can be formed of a variety of materials. For example, in certain desirable embodiments, the panel body is formed of fiberglass. The person of ordinary skill in the art will appreciate that fiberglass is a common and desirable material for acoustic panels. A variety of fiberglass materials can be used in practicing various embodiments of the disclosure. In certain embodiments, the fiberglass is a mineral wool, e.g., glass wool, slag wool, stone wool, vitreous ceramics. Of course, the person of ordinary skill in the art can contemplate use of other similar organic or inorganic materials, e.g., one or more of polyester, polypropylene, polyethylene, acrylic, cotton, silk, wool, cellulose fiber, wood pulp, denim, jute, seagrass, hemp, potassium titanate fiber, Meerschaum (Hydrated Magnesium Silicate) and carbon fiber; these also can be provided in combination with fiberglass. Foamed polymers, e.g., foamed polyurethanes, can also be used to provide the panel body.

In certain desirable embodiments as otherwise described herein, the panel body has a noise reduction coefficient ("NRC") value of at least 0.5, e.g., at least 0.7, at least 0.8, or at least 0.85. For example, in certain embodiments as otherwise described herein, the panel body has an NRC value in the range of 0.5-0.99, e.g., 0.5-0.95, or 0.5-0.9, or 0.7-0.99, or 0.7-0.95, or 0.7-0.9. In certain embodiments as otherwise described herein, the panel body has an NRC value in the range of 0.8-0.99, e.g., 0.8-0.95, or 0.8-0.9, or 0.85-0.99, or 0.85-0.95, or 0.85-0.9. As used herein, a "noise reduction coefficient" or "NRC" describes the arithmetic average (e.g., rounded to the nearest multiple of 0.05), of the absorption coefficients for a specific panel determined at 250 Hz, 500 Hz, 1000 Hz, and 2000 Hz. The person of ordinary skill in the art will appreciate that an "absorption coefficient" of a panel may be determined through standardized testing procedures described in ASTM C423-17 ("Standard Test Method for Sound Absorption and Sound Absorption Coefficients by the Reverberation Room Method").

The panel body also desirably meets the E84 fire safety specification, and has a light-colored surface.

A perimeter frame 120 extends around side edge 116 of panel body 110 and includes a plurality of frame members 122, 124, 126, 128, which include first frame member 122 and second frame 124. A first adhesive 160 bonds a first portion of an inner surface 132 of first frame member 122 to side edge 116 of panel body 110. Further a second adhesive 166 bonds a second portion of inner surface 132 of first frame member 122 to side edge 116 of panel body 110. FIG. 1 shows a simplified schematic cross section of an outer portion of the frame members 122, 124, 128, which is shown in more detail in FIGS. 2 and 3, and exaggerates the gap between side edge 116 and inner surface 132 in order to illustrate the location of first adhesive 160 and second adhesive 166. Further, second adhesive 166 has a substantially reduced working time compared to first adhesive 160.

The members of perimeter frame 120 are coupled to one another using a bracket 180. For example, as shown in FIG. 2, first frame member 122 includes a slot 136 that receives a first portion 182 of bracket 180 and second frame member 124 includes a slot 140 that receives a second portion 188 of bracket 180. Once acoustic panel 100 is fully assembled and the adhesives have set, the respective brackets provide strong connections at the joints between the frame members.

In certain embodiments as otherwise described herein, the first adhesive bonds a first portion of the inner surface of each of the plurality of frame members to the side edge of the panel body, and the second adhesive bonds a second portion of the inner surface of each of the plurality of frame members to the side edge of the panel body. For example, in acoustic panel 100, each of second frame member 124 as well as frame members 126 and 128 are also bonded to the side edge 166 by first adhesive 160 and second adhesive 166. In particular, FIG. 1 illustrates where inner surface 134 of second frame member 124 is bonded to side edge 116 of panel body 110 using both first adhesive 160 and second adhesive 166.

In certain embodiments as otherwise described herein, the working time of the second adhesive is no more than 20% of the working time of the first adhesive, e.g., no more than 10%, e.g., no more than 5%. For example, in certain embodiments, the first adhesive requires several hours to dry and set before the bond of the first adhesive is sufficiently strong to allow additional manufacturing or working steps of the acoustic panel without any additional supports holding the panel together. In contrast, in such embodiments the second adhesive may have a working time of several minutes or less. For example, in some embodiments, the second adhesive reaches 95% of its adhesive strength within 20 minutes of application, e.g., within 10 minutes of application, e.g., within 5 minutes of application, e.g., within 3 minutes of application. In certain embodiments, the second adhesive has an open time of less than 10 minutes, e.g., less than 5 minutes, e.g., less than 3 minutes, e.g., less than 2 minutes.

In certain embodiments as otherwise described herein, the second adhesive is a hot melt adhesive. For example, in some embodiments the second adhesive is a thermoplastic that is applied while heated and sets quickly as the temperature of the adhesive cools. Examples of appropriate hot melt adhesives include polyamides, polyesters, styrene block copolymers, polyethylene, ethylene vinyl acetate polymers, ethylene-acrylate copolymers, such as ethylene-methyl acrylate (EMA) or ethylene n-butyl acrylate (EnBA), and polyolefins.

In certain embodiments, the second adhesive may one or more additives that influence certain performance properties of the adhesive. For example, in some embodiments the second adhesive includes a resin that influences the tack and/or adhesive strength of the adhesive. Examples of possible resins include rosin, hydrogenated rosin, rosin ester, hydrogenated hydrocarbon and terpene phenolics. In some embodiments the second adhesive includes a wax that influences the open time and set time of the adhesive, i.e., the time required for the adhesive to form a bond and the time required to form a bond of a particular strength. Examples of possible waxes include natural waxes, microcrystalline waxes and synthetic waxes. In some embodiments the second adhesive includes an antioxidant that influences the adhesive's degradation. Possible antioxidants include phenols, aromatic amines, phosphates and phosphites. In some embodiments, the second adhesive includes a plasticizer for influencing the flexibility and durability of the adhesive. Other additives are also possible, such as biocides and flame retardants.

In certain embodiments as otherwise described herein, the first adhesive is provided in strips along a length of the first frame member and the second adhesive is provided between the strips of first adhesive along the length of the first frame member. For example, in acoustic panel 100, first adhesive 160 is provided in several strips along the length of first frame member 122. The position of first adhesive 160 ensures that, upon setting of first adhesive 160, a strong bond is formed between first frame member 122 and panel body 110 along the entire length of first frame member 122. Additionally, gaps are provided in the placement of first adhesive 160 along the length of first frame member 122 allowing second adhesive 166 to be periodically positioned between the strips of first adhesive. With its comparably short working time, the sections of second adhesive 166 provided between the strips of first adhesive 160 provide fast bonding between the frame members (e.g., 122) and the panel body 110.

In certain embodiments as otherwise described herein, the first frame member is coupled to the second frame member by a bracket. The bracket includes a first portion that is received in a slot in the first frame member and a second portion that is received in a slot in the second frame member. The first portion includes a first laterally extending projection that engages an inner surface of the slot in the first frame member so as to hinder removal of the bracket from the first frame member. Likewise, the second portion includes a second laterally extending projection that engages an inner surface of the slot in the second frame member so as to hinder removal of the bracket from the second frame member.

Figure 4:
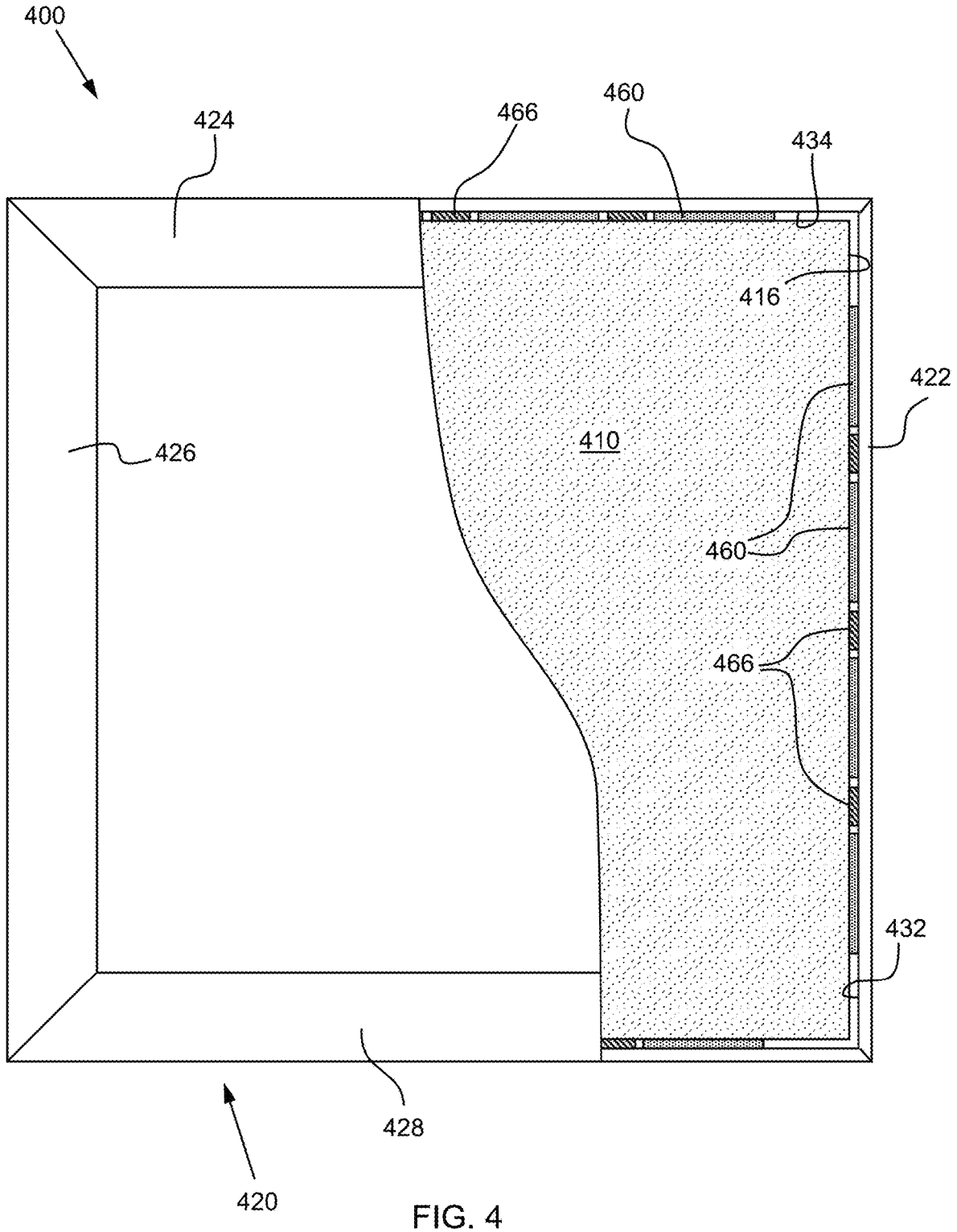
FIG. 4 is a schematic partial cross-sectional top view of an acoustic panel in accordance with another embodiment of the disclosure.
Figure 5:
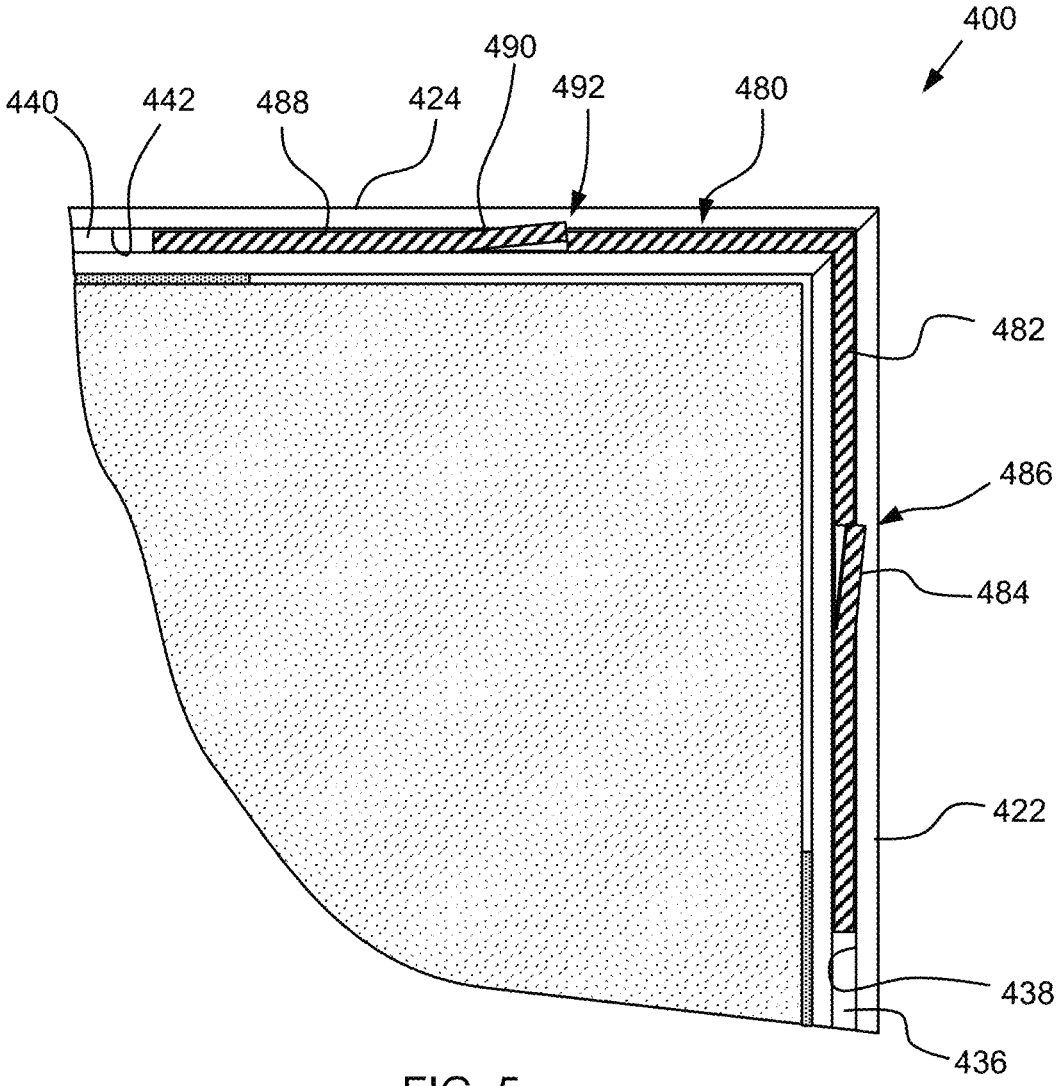
FIG. 5 is a detailed schematic cross-sectional top view of a portion of the acoustic panel of FIG. 4.

An acoustic panel with first and second frame members that are coupled to one another using such a bracket is shown in FIGS. 4 and 5. Acoustic panel 400 includes a panel body 410 including an acoustic material. The panel body 410 includes a side edge 416 that extends around the circumference of panel body 410. A perimeter frame 420 extends around side edge 416 of panel body 410 and includes a plurality of frame members 422, 424, 426, 428, which include first frame member 422 and second frame 424. A first adhesive 460 bonds a first portion of an inner surface 442 of first frame member 422 to side edge 416 of panel body 410. Further a second adhesive 466 bonds a second portion of inner surface 432 of first frame member 422 to side edge 416 of panel body 410. Second adhesive 466 has a substantially reduced working time compared to first adhesive 460. First frame member 422 and second frame member 424 are coupled to one another by a bracket 480. The bracket includes a first portion 482 in the form of a first leg that is received in a slot 436 in first frame 422 member and a second portion 488 in the form of a second leg that is received in a slot 440 in second frame member 424. First leg 482 of bracket 480 includes a first laterally extending projection 484 that engages an inner surface 438 of the slot 436 in first frame member 422 so as to hinder removal of bracket 480 from first frame member 422. Likewise, second leg 488 includes a second laterally extending projection 490 that engages an inner surface 442 of slot 440 in second frame member 424 so as to hinder removal of bracket 480 from second frame member 424.

While acoustic panel 400 includes both multiple adhesives 460, 466 as well as a bracket 480 that includes laterally extending projections, other embodiments may use these features in the alternative. For example, bracket 100, described above, uses a bracket 180 without any lateral projection. Likewise, in some embodiments, a bracket having the laterally extending projections is used with a single adhesive.

For example, in another aspect, the disclosure provides an acoustic panel including a panel body (e.g., comprising fiberglass, or having an NRC value in the range of at least 0.5, e.g., 0.5-0.95 or 0.5-0.9) and a perimeter frame. The panel body includes an upper surface, a lower surface, and a side edge. The perimeter frame extends around the side edge of the panel body and has a plurality of frame members including a first frame member and a second frame member. A first adhesive bonds a first portion of an inner surface of the first frame member to the side edge of the panel body. A bracket couples the first frame member to the second frame member. The bracket includes a first portion that is received in a slot in the first frame member and a second portion that is received in a slot in the second frame member. The first portion includes a first laterally extending projection that engages an inner surface of the slot in the first frame member so as to hinder removal of the bracket from the first frame member. Similarly, the second portion includes a second laterally extending projection that engages an inner surface of the slot in the second frame member so as to hinder removal of the bracket from the second frame member.

Figure 6:
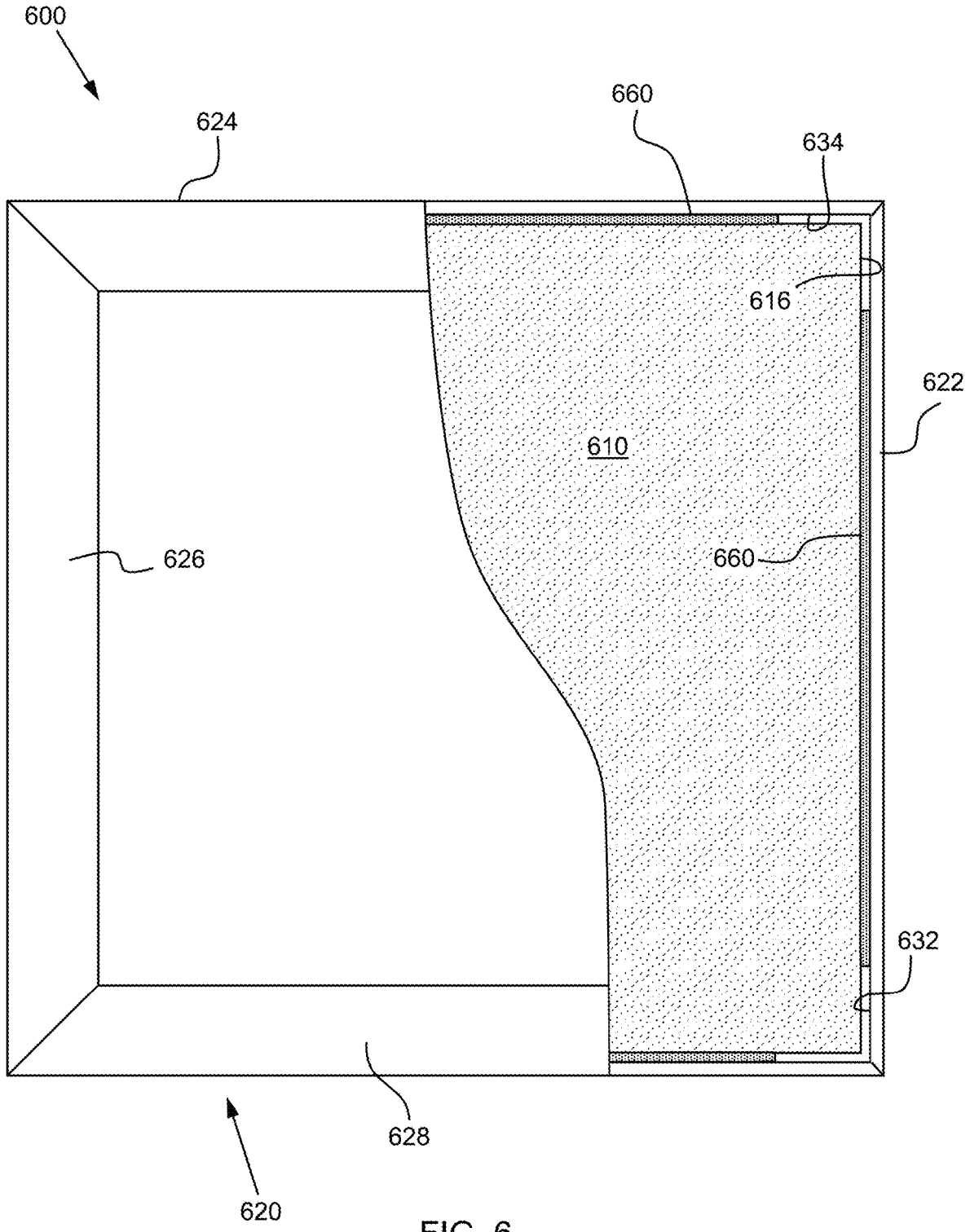
FIG. 6 is a schematic partial cross-sectional top view of an acoustic panel in accordance with another embodiment of the disclosure.
Figure 7:
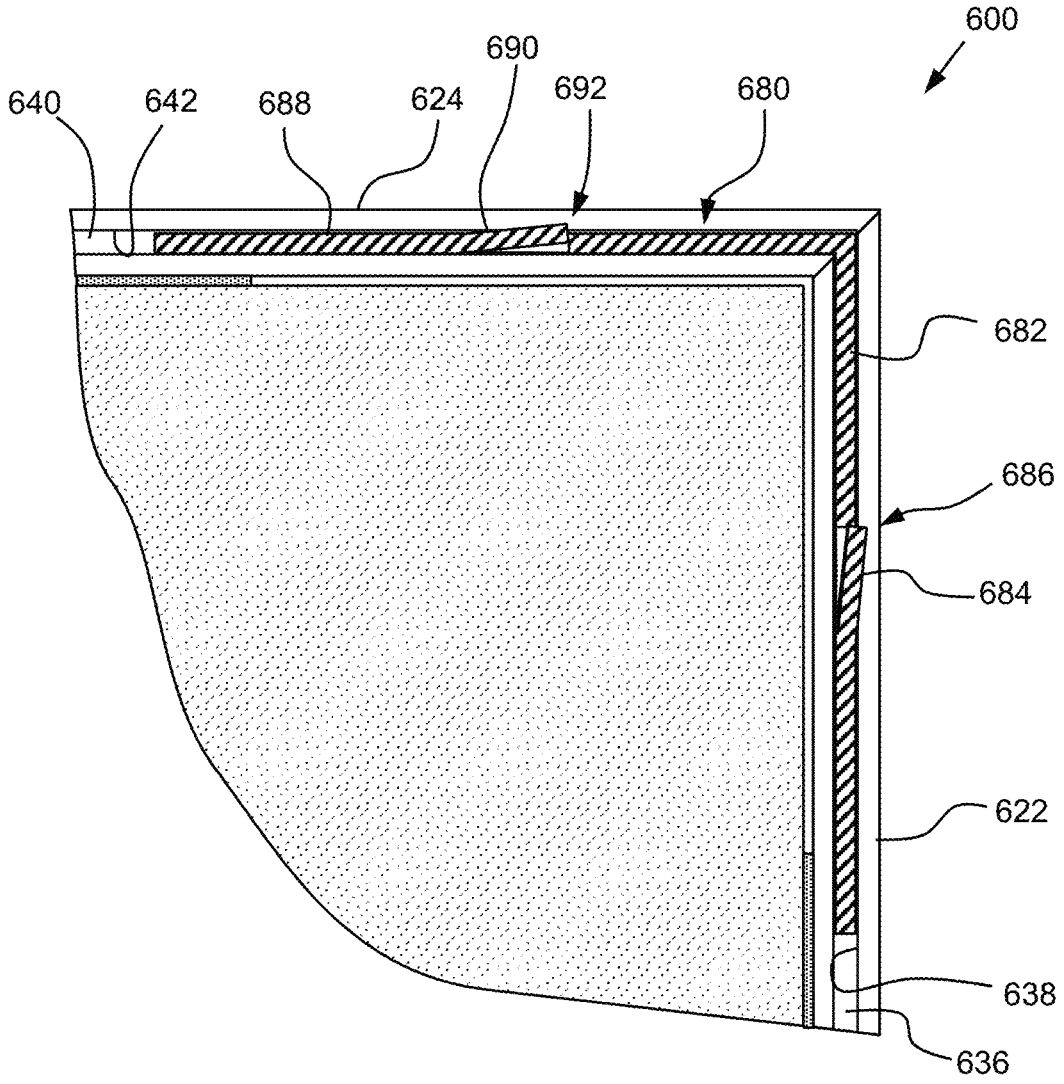
FIG. 7 is a detailed schematic cross-sectional top view of a portion of the acoustic panel of FIG. 6.

Such an acoustic panel is shown in FIGS. 6 and 7. Acoustic panel 600 includes a panel body 610 including an acoustic material. The panel body 610 includes a side edge 616 that extends around the circumference of panel body 610. A perimeter frame 620 extends around side edge 616 of panel body 610 and includes a plurality of frame members 622, 624, 626, 628, which include first frame member 622 and second frame 624. A first adhesive 660 bonds the inner surface 632 of first frame member 622 to side edge 616 of panel body 610. First frame member 622 and second frame member 624 are coupled to one another by a bracket 680. The bracket includes a first portion 682 in the form of a first leg that is received in a slot 636 in first frame 622 member and a second portion 688 in the form of a second leg that is received in a slot 640 in second frame member 624. First leg 682 of bracket 680 includes a first laterally extending projection 684 that engages an inner surface 638 of the slot 636 in first frame member 622 so as to hinder removal of bracket 680 from first frame member 622. Likewise, second leg 688 includes a second laterally extending projection 690 that engages an inner surface 642 of slot 640 in second frame member 624 so as to hinder removal of bracket 680 from second frame member 624.

In certain embodiments as otherwise described herein, friction between the first laterally extending projection and the inner surface of the slot in the first frame member hinders removal of the bracket from the first frame member and friction between the second laterally extending projection and the inner surface of the slot in the second frame member hinders removal of the bracket from the second frame member. For example, in some embodiments, a laterally outward force on each of the laterally extending projections pushes the respective laterally extending projection against the slot in the corresponding frame. This outward force imparts a frictional engagement between the laterally extending projection and an inner surface of the slot that hinders removal of the bracket from the slot.

In certain embodiments as otherwise described herein, the bracket includes a bent metal strip. The term metal strip, as used herein, is not limited to any particular thickness and may include materials conventionally referred to as metal foil, sheet metal, or metal plate. For example, a schematic perspective depiction of bracket 480 is shown alone in FIG. 8. (Bracket 680 also has a similar configuration.) Bracket 480 is formed of a metal strip in the shape of an L, where first leg 482 is disposed at an angle of 90 degrees from second leg 486. The angle between the first and second portions of bracket 480 is based on the square shape of acoustic panel 400. In other embodiments, where the acoustic panel has a different shape, the angle between the first and second portions may be different. Indeed, in some embodiments, there may be no angle between the first and second portions, for example, in an embodiment where the acoustic panel is round.

Figure 8:
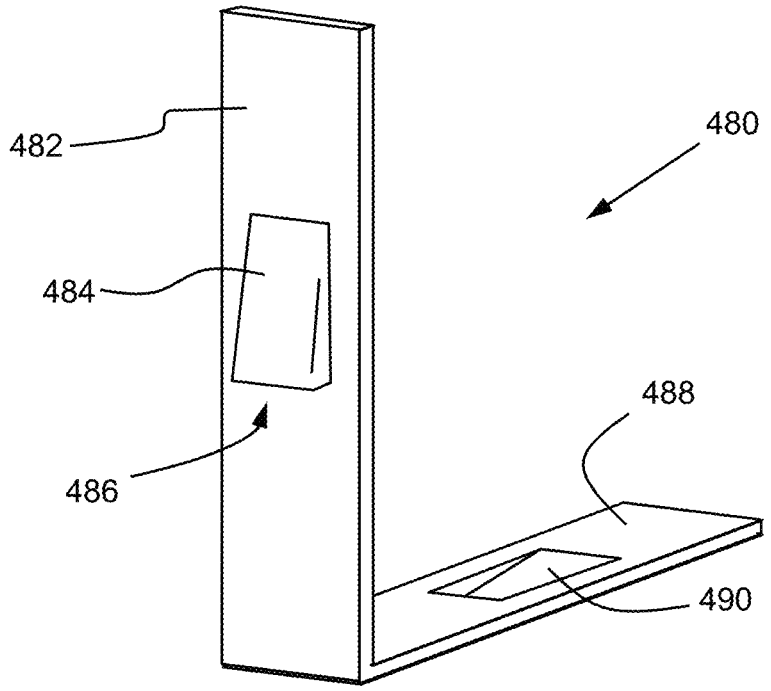
FIG. 8 is a schematic perspective view of a bracket in accordance with an embodiment of the disclosure.

In certain embodiments as otherwise described herein, the first and second laterally extending projections are bent outward from a surface of the metal strip. For example, as shown in FIG. 8, first laterally extending projection 484 is bent outward from the planar surface of first portion 482 of bracket 480. Likewise, second laterally extending projection 490 is bent outward from the planar surface of second portion 488.

In certain embodiments as otherwise described herein, the thickness of each leg of the bracket is thicker than the slot in the corresponding frame member. For example, the thickness of first leg or first portion 482 of bracket 480, when including the laterally extending projection 484, is thicker than the slot 436 is first frame member 422. In particular, while the thickness of the metal strip that forms bracket 480 is thinner than slot 436, the laterally extending projection 484 increases the thickness of first portion 482 to the extent that the first bracket portion 482 is thicker than slot 436. As a result, the initial insertion of the end of first portion 482 into slot 436 is not met with any resistance. However, as laterally extending projection 484 is inserted into slot 436, it is deformed and pressed closed, such that laterally extending projection 484 exerts an outward force against the inside surface 448 of slot 436.

Figure 9:
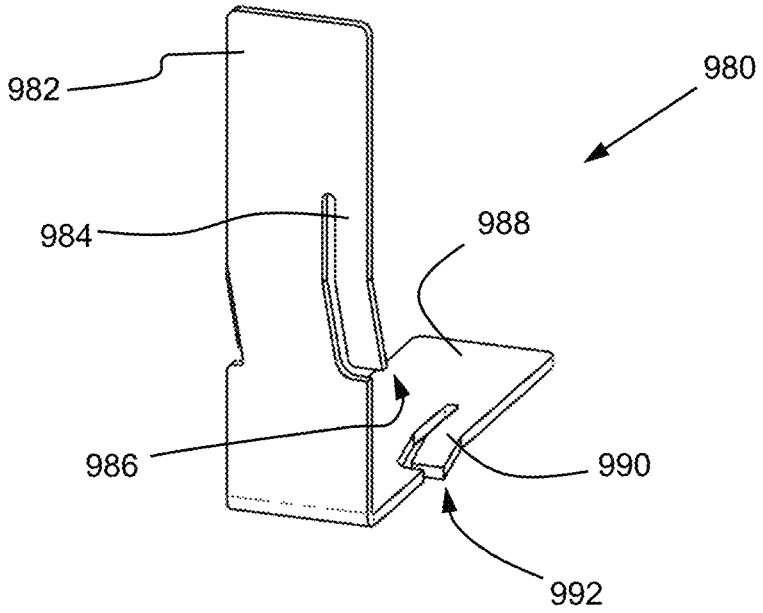
FIG. 9 is a schematic perspective view of another bracket in accordance with an embodiment of the disclosure.

In certain embodiments as otherwise described herein, the first and second laterally extending projections protrude from a side edge of the metal strip. For example, FIG. 9 shows such a bracket. Bracket 980 includes a first laterally extending projection 984 that extends outward from a side edge of the part of the metal strip that forms first portion 982 of bracket 980. Likewise, second laterally extending projection 990 extends outward from a side edge of the part of the metal strip that forms second portion 988 of bracket 980. In some embodiments, the laterally extending projections extend from the same side edge of the bracket, while in other embodiments, the laterally extending projections extend from opposite edges. For example, first and second laterally extending projections 984, 990 extend from the same side edge of the metal strip that forms the bracket. Further, in other embodiments, laterally extending projections may extend outward from both side edges of the bracket.

In certain embodiments as otherwise described herein, the width of each leg of the bracket is thicker than the width of the slot in the corresponding frame member. For example, the width of first leg or first portion 982 of bracket 980, when including the laterally extending projection 984, may be thicker than the slot is a frame member in which the bracket 980 is inserted. In particular, while the width of the metal strip along much of the bracket 980 may be smaller than the corresponding slot, the laterally extending projection 984 increases the width of first portion 982 to the extent that the first bracket portion 982 is wider than the corresponding slot. As a result, the initial insertion of the end of first portion 982 into the slot is not met with any resistance. However, as laterally extending projection 984 is inserted into the slot, it is deformed and pressed inward, such that laterally extending projection 984 exerts an outward force against the inside surface of the corresponding slot.

In certain embodiments as otherwise described herein, the first laterally extending projection includes a sharp edge that engages the inner surface of the slot in first frame member, and the second laterally extending projection includes a sharp edge that engages the inner surface of the slot in the second frame. For example, first laterally extending projection 484 of bracket 480 of an acoustic panel 400 has a sharp edge 486 that engages the inner surface 438 of the slot 436 in first frame member 422. Likewise, second laterally extending projection 490 has a sharp edge 492 that engages an inner surface 442 of slot 440 in second frame member 424. The sharp edges may deform the inner surface of the corresponding slot and form an indent therein, which aids in hindering removal of the bracket from the slot. Similarly, first laterally extending projection 684 of bracket 680 of acoustic panel 600 has a sharp edge 686 that engages the inner surface 638 of the slot 636 in first frame member 622. Likewise, second laterally extending projection 690 has a sharp edge 692 that engages an inner surface 642 of slot 640 in second frame member 624. The sharp edges may deform the inner surface of the corresponding slot and form an indent therein, which aids in hindering removal of the bracket from the slot.

In certain embodiments, the sharp edge of each laterally extending projection faces toward the middle of the bracket. For example, the sharp edge on the first laterally extending projection faces the joint where the first and second laterally extending projections meet. In some embodiments, the sharp edge is at the inner end of the laterally extending projection. For example, sharp edge 486 is disposed on the inward end of first laterally extending projection 484 and faces the joint where first portion 482 and second portion 488 meet. In contrast, the outer end of laterally extending projection 484 is gradually sloped. Accordingly, as the first portion 482 of bracket 480 is inserted into the slot in first frame member 422, the gradual slope causes the laterally extending projection 484 to bend inward. On the other hand, if a force is exerted on bracket 480 to remove the first portion 482 from the slot, the sharp edge 486 will catch against the inner surface of the slot. The second laterally extending projection 490 has a similar configuration, where the sharp edge is disposed at the inner end of the laterally extending projection 490 and faces the joint.

Bracket 980 shows another example including laterally extending projections that have sharp edges with a similar configuration. Specifically, sharp edge 986 is disposed on the inward end of first laterally extending projection 984 and faces the joint where first portion 982 and second portion 988 meet. In contrast, the outer end of laterally extending projection 984 is gradually sloped toward the sharp edge. Accordingly, as the first portion 982 is inserted into a receiving slot in a first frame member, the gradual slope of the laterally extending projection 984 will allow it to bend inward. On the other hand, if a force is exerted on bracket 980 to remove it from the first frame member, the sharp edge 986 will catch on an inner surface of the slot, hindering its removal. Likewise, laterally extending projection 990 has a similar configuration, with sharp edge 992 facing the joint between first portion 982 and second portion 988. As a result, laterally extending projection 990 will also allow insertion into the slot of the second frame member but hinder removal therefrom.

In certain embodiments as otherwise described herein, the first and second frame members are formed of a first material and the bracket is formed of a second material, and wherein the first material is softer than the second material. Once the brackets are inserted into the slots in the corresponding frame members, the sharp edge of the bracket can pierce the surface of the softer frame material, which strengthens the connection between these components and prevents removal of the bracket from the slot. For example, in some embodiments, the brackets are formed of steel and the frame members are formed of a softer material, such that the sharp edge of the steel brackets can form an indent into the surface of the frame member. In some embodiments, the brackets are formed of an aluminum alloy, which provides a particularly strong connection between the sharp edge of a bracket of steel and the frame member.

In certain embodiments, the bracket is punched from a metal sheet. For example, bracket 480 is formed by being punched from a metal sheet while simultaneously forming the laterally extending projection during the punching process. In some embodiments the bend between the first and second portions of the bracket is formed after the shape of the bracket has been punched from the metal sheet. In other embodiments, the bracket is bent during the punching process.

In certain embodiments, the bracket is cut from a metal sheet. For example, bracket 980 is cut from a flat metal sheet and then the first and second portions 982, 988 are bent with respect to one another. As will be appreciated by those of ordinary skill in the art, the bracket can be cut from the metal sheet using various different methods, such as laser cutting or water jet cutting.

In certain embodiments as otherwise described herein, the bracket has a width in a range from ¼ inch to 2 inches, e.g., from ¼ inch to 1 inch, e.g., from ⅜ inch to ½ inch. In certain embodiments as otherwise described herein, each of the first and second portions of the bracket has a length in a range from ½ inch to 3 inches, e.g., from 1 inch to 2 inches.

In certain embodiments as otherwise described herein, the ends of the bracket include chamfered or rounded corners. For example, bracket 980 includes rounded corners. The rounded or chamfered corners are beneficial for guiding the bracket as it is inserted into the slot of the corresponding frame member.

In certain embodiments as otherwise described herein, the panel has a length in a range from 1 ft. to 20 ft., e.g., in a range from 2 ft. to 10 ft., e.g., about 2 ft., about 3 ft., about 4 ft., about 5 ft., about 6 ft., about 7 ft., about 8 ft., about 9 ft., or about 10 ft. In certain embodiments as otherwise described herein, the panel has a width in a range from 1 ft. to 10 ft., e.g., about 1 ft., about 2 ft., about 3 ft., about 4 ft., about 5 ft., about 6 ft., about 7 ft., about 8 ft., about 9 ft., or about 10 ft. For example, one embodiment of an acoustic panel has length of 10 ft. and a width of 4 ft. Of course, a wide range of other combinations are possible. The term length and width, as used herein, are not confined to any particular shape of the acoustic panel. The term length is used to identify the longest dimension of the panel along a surface of the panel and between parallel edges thereof. The term width is used to identify a direction that is perpendicular to the length and extends from one edge of the panel to another. For example, the length and width of a circular panel are the same and the length and width dimensions are both measured from opposite sides of the panel where the opposing edges are parallel to one another.

Figure 10:
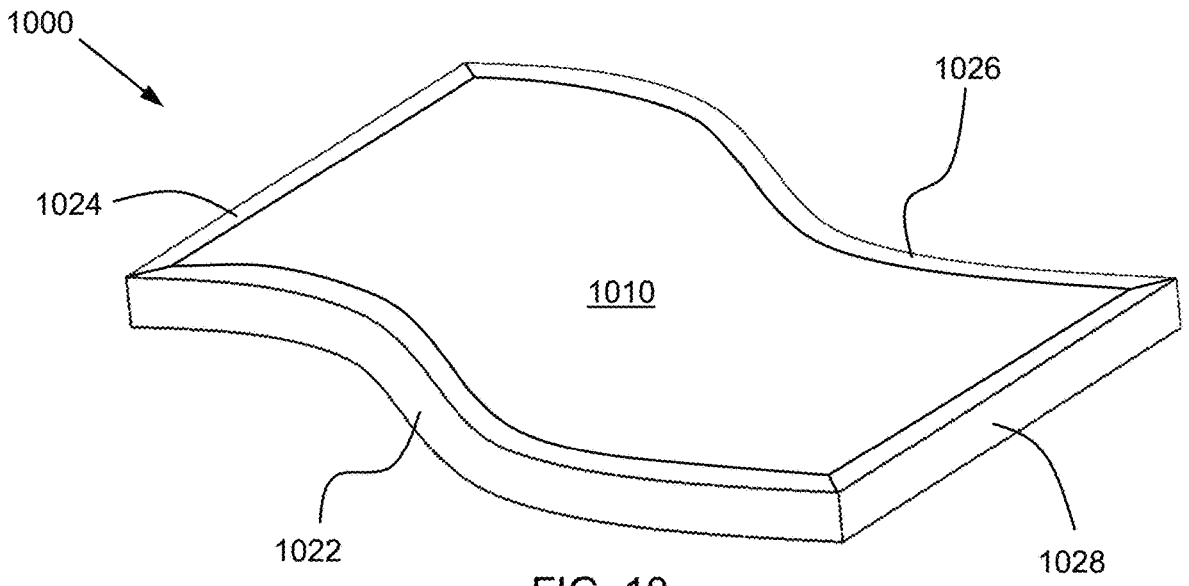
FIG. 10 is a schematic perspective view of an acoustic panel according to another embodiment of the disclosure.

In certain embodiments as otherwise described herein, the acoustic panel has a thickness in a range from 0.5 inches to 3 inches, e.g., 1 inch to 2.5 inches. The term thickness, as used herein, refers to the measurement through the acoustic panel at a particular point on the surface of the panel. Thus, the term thickness does not incorporate the overall height dimension of the panel resulting from curvature in the surface of the panel. In other words, a curved panel (such as that shown in FIG. 10) may have an overall height dimension of several feet, while the dimension of the material at any particular point on the surface of the panel is only 1 inch. As the term is used herein, the thickness of such a panel would be 1 inch.

In certain embodiments as otherwise described herein, the acoustic panel has a noise reduction coefficient of at least 0.5, e.g., at least 0.7, e.g., at least 0.8, e.g., at least 0.85. As used herein, a "noise reduction coefficient" or "NRC" describes the arithmetic average (e.g., rounded to the nearest multiple of 0.05), of the absorption coefficients for a specific panel determined at 250 Hz, 500 Hz, 1000 Hz, and 2000 Hz. The person of ordinary skill in the art will appreciate that an "absorption coefficient" of a panel may be determined through standardized testing procedures described in ASTM C423-17 ("Standard Test Method for Sound Absorption and Sound Absorption Coefficients by the Reverberation Room Method"). The person of ordinary skill in the art will further appreciate that, while intended to describe the fraction of randomly incident sound power absorbed by a surface, an absorption coefficient is defined operationally, and accordingly, highly absorptive panels can have an absorption coefficient exceeding unity at one or more frequencies.

In certain embodiments as otherwise described herein, a surface of the panel has a light reflectance of at least 75%, e.g., at least 80%, e.g., about 90%. For example, the lower surface of acoustic panel used as a ceiling panel may be tinted white, for example by paint, and have a light reflectance of 85%. In other embodiments, the panel may have other decorative characteristics and have a lower light reflectance. For example, in some embodiments, the surfaces of the acoustic panels is dark and has low light reflectance.

In certain embodiments as otherwise described herein, the panel is planar. For example, acoustic panel 100 includes flat upper and lower surfaces resulting in a planar panel. In other embodiments, the panel has a curved contour. For example, acoustic panel 1000, shown in FIG. 10 has a curved contour including an upper region that slopes down to a lower region. To accommodate such a contour, both the panel body 1010 and frame members 1022, 1026 are curved. While the curvature of acoustic panel 1000 is only along the length of the panel, such that frame members 1024 and 1028 are straight, in other embodiments all of the frame members may be curved.

In certain embodiments as otherwise described herein, each of the frame members is formed of an aluminum alloy. In certain embodiments as otherwise described herein, each of the frame members is an extruded member. For example, each of the frame members 122, 124, 126, 128 of acoustic panel 100 is formed as an extruded aluminum member. The aluminum provides a strong and light material for the outer perimeter of the panel.

In certain embodiments as otherwise described herein, each of the frame members includes an upper arm that covers a portion of the upper surface of the panel body and a side arm that forms the inner surface that is bonded to the side edge of the panel. For example, as shown in FIG. 3, frame member 132 includes an upper arm 144 and a side arm 146 that are connected at a corner of the frame member. Upper arm 144 provides structural rigidity to the frame member and protects the outer edge of panel body 110. Side arm 146 includes both slot 136 in which bracket 180 is received, as well as the inner surface 132 that is bonded to panel body 110. Each of the other frame members of perimeter frame 120 has a similar configuration. Likewise, any of the frame members of the various embodiments described herein may have the configuration of frame member 122 shown in FIG. 3. Of course, other configurations are also possible.

In certain embodiments as otherwise described herein, each of the frame members includes a flange extending inward from the inner surface and the panel body includes a slot extending inward from the side edge, where the flanges of the frame members are received in the slot. For example, frame member 122, as shown in FIG. 3, includes a flange 148 that extends inward from inner surface 132. Flange 148 is received in a slot 118 that extends inward from side edge 116 of panel body 110. The insertion of flange 148 into slot 118 forms a secure connection between the panel body and the respective frame member. In some embodiments, the slot extends continuously around the entire perimeter of the panel body. In other embodiments, the slot is formed in separate sections around the panel body. In some embodiments, adhesive is provided in the slot and bonds the flange to the panel body within the slot.

In certain embodiments, the flange includes a textured surface. The textured surface of the flange may promote a positive engagement between the flange and the slot of the panel body. For example, flange 148 includes a plurality of ribs that engage with the slot 118 of panel body 110 and form a positive engagement between frame member 122 and panel body 110 hindering removal of flange 148 from slot 118.

Figure 11:
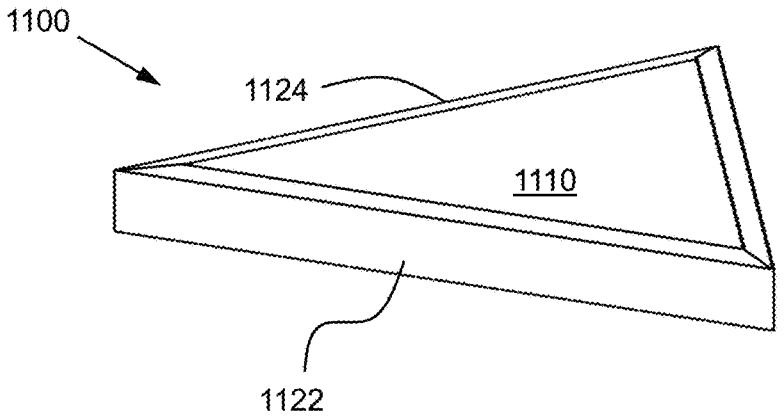
FIG. 11 is a schematic perspective view of an acoustic panel according to yet another embodiment of the disclosure.
Figure 12:
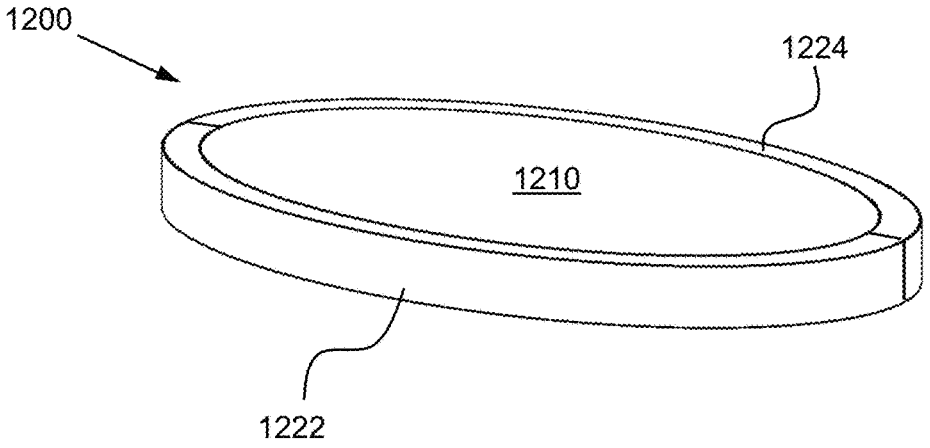
FIG. 12 is a schematic perspective view of an acoustic panel according to still another embodiment of the disclosure.

In certain embodiments as otherwise described herein, the first and second frame members are straight, and wherein the acoustic panel as a polygonal shape. For example, first frame member 122 and second frame member 124 are both straight and acoustic panel 100 has the shape of a square. Likewise, FIG. 11 shows another embodiment of such an acoustic panel. Acoustic panel 1100 includes a first frame member 1122 that is straight and a second frame member 1124 that is straight. The third frame member is also straight, and the overall shape of acoustic panel 1100 is a triangle.

In certain embodiments as otherwise described herein, the first and second frame members are coupled in a miter joint. For example, as shown in FIG. 2, first frame member 122 and second frame member 124 are coupled to one another by a miter joint at an angle of 90 degrees. Similarly, first frame member 1122 and second frame member 1124 of acoustic panel 1100 are coupled to each other by a miter joint having an angle of 60 degrees. As will be appreciated by those of ordinary skill in the art, larger or smaller angles are also possible and may be selected to accommodate the overall shape of the acoustic panel.

In certain embodiments as otherwise described herein, the first and second frame members are curved, and wherein the panel body has a curved edge. For example, first frame member 1222 and second frame member 1224 of acoustic panel 1200 are both curved and extend around the perimeter of panel body 1210. The shape of panel body 1210 and the corresponding shape of acoustic panel 1200 is elliptical. In other embodiments, the acoustic panel has other curved shapes, such as rounded squares, circles, ovals or irregular curved shapes. Further, in some embodiments the frame includes both curved and straight frame members.

In certain embodiments as otherwise described herein, the panel body has a density in a range of 4 to 15 lbs. per cubic foot, e.g., 5 to 10 lbs. per cubic foot, e.g., 6 to 7 lbs. per cubic foot. In combination with the materials of the frame members, the density of the panel body controls the overall weight of the acoustic panel.

In certain embodiments as otherwise described herein, the first adhesive is an elastomeric glue. For example, the first adhesive may include natural or synthetic elastomers, such as rubber. In some embodiments, the first adhesive includes one or more resins that increase the tack and shear properties of the adhesive.

In certain embodiments as otherwise described herein, the first adhesive is a water-based glue. For example, in some embodiments the first adhesive is a water-based solvent-free glue.

In certain embodiments as otherwise described herein, the first adhesive is a white glue.

In certain embodiments, the first adhesive requires at least one hour from application to achieve 95% of its adhesive strength. For example, in some embodiments, the first adhesive requires several hours to set. In other embodiments, the first adhesive may be a fast setting adhesive.

In another aspect, the disclosure provides a method of manufacturing an acoustic panel according to the disclosure. The method includes applying a first adhesive between a side edge of a panel body (e.g., comprising fiberglass, or having an NRC value in the range of at least 0.5, e.g., 0.5-0.95 or 0.5-0.9) and an inner surface of a first frame member of a perimeter frame. A second adhesive is also applied between the side edge of the panel body and the inner surface of the first frame member, where the second adhesive has a substantially reduced working time compared to the first adhesive. The frame members of the perimeter frame are then secured around the side edge of the panel body.

Acoustic panel 100 illustrates an embodiment of a panel manufactured according to such a method. In order to introduce the adhesives between the side edge 116 of panel body 110 and inner surface 132 of first frame member 122, the adhesives may be applied to either or both of the frame member and the panel body before they are secured to one another. During assembly, the frame members 132, 134, 136, 138 are coupled to one another and secured around the side edge 116 of the panel body 110 to form the assembled acoustic panel 100.

In another aspect, the disclosure provides a method of manufacturing an acoustic panel according to the disclosure. The method includes applying a first adhesive between a side edge of a panel body (e.g., comprising fiberglass, or having an NRC value in the range of at least 0.5, e.g., 0.5-0.95 or 0.5-0.9) and an inner surface of a first frame member of a perimeter frame. The method also includes coupling the first frame member to a second frame member of the perimeter frame using a bracket by inserting a first portion of the bracket into a slot in the first frame and inserting a second portion of the bracket in to a slot in the second frame. The first portion of the bracket includes a first laterally extending projection having a sharp edge that engages an inner surface of the slot in the first frame member so as to hinder removal of the bracket from the first frame member and the second portion of the bracket includes a second laterally extending projection having a sharp edge that engages an inner surface of the slot in the second frame member so as to hinder removal of the bracket from the second frame member.

Acoustic panel 400 illustrates an embodiment of a panel manufactured according to such a method. In order to introduce the adhesive between the side edge 416 of panel body 410 and inner surface 432 of first frame member 422, the adhesive may be applied to either or both of the frame member and the panel body before they are secured to one another. During assembly, the frame members 422, 424, 426, 428 are coupled to one another using brackets. For example, first frame member 422 is coupled to second frame member 434 by inserting a first portion 482 of the bracket 480 into a slot 436 in first frame 422 and inserting a second portion 488 of bracket 480 into a slot 440 in second frame 424. The first portion 482 of bracket 480 includes a first laterally extending projection 484 having a sharp edge 486 that engages an inner surface 438 of slot 436 of first frame member 422 so as to hinder removal of the bracket from first frame member 422. Likewise, the second portion 488 of bracket 480 includes a second laterally extending projection 490 having a sharp edge 492 that engages an inner surface 442 of slot 440 in second frame member 424 so as to hinder removal of bracket 480 from second frame member 424.

In certain embodiments as otherwise described herein, each of the frame members includes a flange extending inward from the inner surface, and wherein the panel body includes a slot extending inward from the side edge, the method further comprising inserting the flange of each frame member into the slot in the side edge of the panel body. For example, as first frame member 122 is secured to panel body 110, flange 148 of first flange 122 is inserted into slot 118 formed on side edge 116 of panel body 110.

Further aspects of the disclosure are provided by the enumerated embodiments listed below, which can be combined in any combination and in any number that is not logically or technically inconsistent.

Embodiment 1

An acoustic panel comprising:

a panel body, the panel body including an upper surface, a lower surface, and a side edge;

a perimeter frame extending around the side edge of the panel body, the perimeter frame including a plurality of frame members comprising a first frame member and a second frame member;

a first adhesive bonding a first portion of an inner surface of the first frame member to the side edge of the panel body; and a second adhesive bonding a second portion of the inner surface of the first frame member to the side edge of the panel body, the second adhesive having a substantially reduced working time compared to the first adhesive.

Embodiment 2

The acoustic panel according to embodiment 1, wherein the first adhesive bonds a first portion of the inner surface of each of the plurality of frame members to the side edge of the panel body, and the second adhesive bonds a second portion of the inner surface of each of the plurality of frame members to the side edge of the panel body.

Embodiment 3

The acoustic panel according to embodiment 1 or embodiment 2, wherein the working time of the second adhesive is no more than 20% of the working time of the first adhesive, e.g., no more than 10%, e.g., no more than 5%.

Embodiment 4

The acoustic panel according to any of embodiments 1 to 3, wherein the second adhesive is a hot melt adhesive.

Embodiment 5

The acoustic panel according to any of embodiments 1 to 4, wherein the first adhesive is provided in strips along a length of the first frame member and the second adhesive is provided between the strips of first adhesive along the length of the first frame member.

Embodiment 6

The acoustic panel according to any of embodiments 1 to 5, wherein the first frame member is coupled to the second frame member by a bracket, the bracket comprising:

a first portion that is received in a slot in the first frame member, the first portion including a first laterally extending projection that engages an inner surface of the slot in the first frame member so as to hinder removal of the bracket from the first frame member, and a second portion that is received in a slot in the second frame member, the second portion including a second laterally extending projection that engages an inner surface of the slot in the second frame member so as to hinder removal of the bracket from the second frame member.

Embodiment 7

An acoustic panel comprising:

a panel body, the panel body including an upper surface, a lower surface, and a side edge;

a perimeter frame extending around the side edge of the panel body, the perimeter frame including a plurality of frame members comprising a first frame member and a second frame member;

a first adhesive bonding a first portion of an inner surface of the first frame member to the side edge of the panel body; and a bracket coupling the first frame member to the second frame member, the bracket comprising:

a first portion that is received in a slot in the first frame member, the first portion including a first laterally extending projection that engages an inner surface of the slot in the first frame member so as to hinder removal of the bracket from the first frame member, and a second portion that is received in a slot in the second frame member, the second portion including a second laterally extending projection that engages an inner surface of the slot in the second frame member so as to hinder removal of the bracket from the second frame member.

Embodiment 8

The acoustic panel according to embodiment 6 or embodiment 7, wherein friction between the first laterally extending projection and the inner surface of the slot in the first frame member hinders removal of the bracket from the first frame member, and wherein friction between the second laterally extending projection and the inner surface of the slot in the second frame member hinders removal of the bracket from the second frame member.

Embodiment 9

The acoustic panel according to embodiment 6 or embodiment 7, wherein the first laterally extending projection includes a sharp edge that engages the inner surface of the slot in first frame member, and wherein the second laterally extending projection includes a sharp edge that engages the inner surface of the slot in the second frame.

Embodiment 10

The acoustic panel according to any of embodiments 6 to 9, wherein the bracket includes a bent metal strip.

Embodiment 11

The acoustic panel according to embodiment 10, wherein the first and second laterally extending projections are bent outward from a surface of the metal strip.

Embodiment 12

The acoustic panel according to embodiment 11, wherein the first and second laterally extending projections protrude from a side edge of the metal strip.

Embodiment 13

The acoustic panel according to any of embodiments 6 to 12, wherein the first and second frame members are formed of a first material and the bracket is formed of a second material, and wherein the first material is softer than the second material.

Embodiment 14

The acoustic panel according to any of embodiments 6 to 13, wherein the bracket comprises steel.

Embodiment 15

The acoustic panel according to any of embodiments 1 to 14, wherein the acoustic panel has a length in a range from 1 ft. to 20 ft., e.g., in a range from 2 ft. to 10 ft., e.g., about 2 ft., about 3 ft., about 4 ft., about 5 ft., about 6 ft., about 7 ft., about 8 ft., about 9 ft., or about 10 ft.

Embodiment 16

The acoustic panel according to any of embodiments 1 to 15, wherein the acoustic panel has a width in a range from 1 ft. to 10 ft., e.g., about 1 ft., about 2 ft., about 3 ft., about 4 ft., about 5 ft., about 6 ft., about 7 ft., about 8 ft., about 9 ft., or about 10 ft.

Embodiment 17

The acoustic panel according to any of embodiments 1 to 16, wherein the acoustic panel has a thickness in a range from 0.25 inches to 7 inches, e.g., 0.5 inches to 3 inches, e.g., 1 inch to 2.5 inches.

Embodiment 18

The acoustic panel according to any of embodiments 1 to 17, wherein the acoustic panel has a noise reduction coefficient of at least 0.7, e.g., at least 0.8, e.g., at least 0.85.

Embodiment 19

The acoustic panel according to any of embodiments 1 to 18, wherein a surface of the acoustic panel has a light reflectance of at least 75%, e.g., at least 80%, e.g., about 90%.

Embodiment 20

The acoustic panel according to any of embodiments 1 to 19, wherein the acoustic panel is planar.

Embodiment 21

The acoustic panel according to any of embodiments 1 to 19, wherein the acoustic panel has a curved contour.

Embodiment 22

The acoustic panel according to any of embodiments 1 to 21, wherein each of the frame members is formed of an aluminum alloy.

Embodiment 23

The acoustic panel according to any of embodiments 1 to 22, wherein each of the frame members is an extruded member.

Embodiment 24

The acoustic panel according to any of embodiments 1 to 23, wherein each of the frame members includes:

an upper arm that covers a portion of the upper surface of the panel body, and a side arm that forms the inner surface that is bonded to the side edge of the panel body.

Embodiment 25

The acoustic panel according to any of embodiments 1 to 24, wherein each of the frame members includes a flange extending inward from the inner surface, and wherein the panel body includes a slot extending inward from the side edge and the flanges of the frame members are received in the slot.

Embodiment 26

The acoustic panel according to any of embodiments 1 to 25, wherein the first and second frame members are straight, and wherein the acoustic panel as a polygonal shape.

Embodiment 27

The acoustic panel according to embodiment 26, wherein the first and second frame members are coupled in a miter joint.

Embodiment 28

The acoustic panel according to any of embodiments 1 to 25, wherein the first and second frame members are curved, and wherein the panel body has a curved edge.

Embodiment 29

The acoustic panel according to any of embodiments 1 to 28, wherein the panel body has a density in a range from 2 to 20 lbs. per cubic foot, e.g., 4 to 15 lbs. per cubic foot, e.g., 5 to 10 lbs. per cubic foot, e.g., 6 to 7 lbs. per cubic foot.

Embodiment 30

The acoustic panel according to any of embodiments 1 to 29, wherein the panel body comprises fiberglass.

Embodiment 31

The acoustic panel according to any of embodiments 1 to 29, wherein the panel body comprises one or more of one or more of polyester, polypropylene, polyethylene, acrylic, cotton, silk, wool, cellulose fiber, wood pulp, denim, jute, seagrass, hemp, potassium titanate fiber, Meerschaum (Hydrated Magnesium Silicate) and carbon fiber.

Embodiment 32

The acoustic panel according to any of embodiments 1 to 31, wherein the panel body has a noise reduction coefficient ("NRC") value of at least 0.5, e.g., at least 0.7, at least 0.8, or at least 0.85.

Embodiment 33

The acoustic panel according to any of embodiments 1 to 31, wherein the panel body has an NRC value in the range of 0.5-0.99, e.g., 0.5-0.95, or 0.5-0.9, or 0.7-0.99, or 0.7-0.95, or 0.7-0.9.

Embodiment 34

The acoustic panel according to any of embodiments 1 to 31, wherein the panel body has an NRC value in the range of 0.8-0.99, e.g., 0.8-0.95, or 0.8-0.9, or 0.85-0.99, or 0.85-0.95, or 0.85-0.9.

Embodiment 35

The acoustic panel according to any of embodiments 1 to 34, wherein the first adhesive has is an elastomeric glue.

Embodiment 36

The acoustic panel according to any of embodiments 1 to 34, wherein the first adhesive is a water-based glue.

Embodiment 37

The acoustic panel according to any of embodiments 1 to 36, wherein the first adhesive is a white glue.

Embodiment 38

The acoustic panel according to any of embodiments 1 to 37, wherein the first adhesive requires at least one hour from application to achieve 95% of its adhesive strength.

Embodiment 39

A method of manufacturing an acoustic panel according to any of embodiments 1 to 38, the method comprising:

applying a first adhesive between a side edge of a panel body and an inner surface of a first frame member of a perimeter frame;

applying a second adhesive between the side edge of the panel body and the inner surface of the first frame member, wherein the second adhesive has a substantially reduced working time compared to the first adhesive; and securing the frame members of the perimeter frame around the side edge of the panel body.

Embodiment 40

The method of embodiment 39, further comprising coupling the first frame member to a second frame member of the perimeter frame using a bracket by inserting a first portion of the bracket into a slot in the first frame and inserting a second portion of the bracket in to a slot in the second frame, wherein the first portion of the bracket includes a first laterally extending projection having a sharp edge that engages an inner surface of the slot in the first frame member so as to hinder removal of the bracket from the first frame member, and the second portion of the bracket includes a second laterally extending projection having a sharp edge that engages an inner surface of the slot in the second frame member so as to hinder removal of the bracket from the second frame member.

Embodiment 41

A method of manufacturing an acoustic panel according to any of embodiments 1 to 38, the method comprising:

applying a first adhesive between a side edge of a panel body and an inner surface of a first frame member of a perimeter frame;

coupling the first frame member to a second frame member of the perimeter frame using a bracket by inserting a first portion of the bracket into a slot in the first frame and inserting a second portion of the bracket in to a slot in the second frame, wherein the first portion of the bracket includes a first laterally extending projection having a sharp edge that engages an inner surface of the slot in the first frame member so as to hinder removal of the bracket from the first frame member, and the second portion of the bracket includes a second laterally extending projection having a sharp edge that engages an inner surface of the slot in the second frame member so as to hinder removal of the bracket from the second frame member.

42. The method according to any of embodiments 39 to 41, wherein each of the frame members includes a flange extending inward from the inner surface, and wherein the panel body includes a slot extending inward from the side edge, the method further comprising inserting the flange of each frame member into the slot in the side edge of the panel body.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. An acoustic panel comprising:

a panel body, the panel body including an upper surface, a lower surface, and a side edge;

a perimeter frame extending around the side edge of the panel body, the perimeter frame including a plurality of frame members comprising a first frame member and a second frame member;

a first adhesive bonding a first portion of an inner surface of the first frame member to the side edge of the panel body; and one or more of (i) a second adhesive bonding a second portion of the inner surface of the first frame member to the side edge of the panel body, the second adhesive having a substantially reduced working time compared to the first adhesive; and (ii) a bracket coupling the first frame member to the second frame member, the bracket comprising:

a first portion that is received in a slot in the first frame member, the first portion including a first laterally extending projection that engages an inner surface of the slot in the first frame member so as to hinder removal of the bracket from the first frame member, and a second portion that is received in a slot in the second frame member, the second portion including a second laterally extending projection that engages an inner surface of the slot in the second frame member so as to hinder removal of the bracket from the second frame member.

2. The acoustic panel according to claim 1, comprising the second adhesive.

3. The acoustic panel according to claim 2, wherein the first adhesive bonds a first portion of the inner surface of each of the plurality of frame members to the side edge of the panel body, and the second adhesive bonds a second portion of the inner surface of each of the plurality of frame members to the side edge of the panel body.

4. The acoustic panel according to claim 2, wherein the working time of the second adhesive is no more than 20% of the working time of the first adhesive, e.g., no more than 10%, e.g., no more than 5%.

5. The acoustic panel according to claim 2, wherein the second adhesive is a hot melt adhesive.

6. The acoustic panel according to claim 2, wherein the first adhesive is provided in strips along a length of the first frame member and the second adhesive is provided between the strips of first adhesive along the length of the first frame member.

7. The acoustic panel according to claim 1, comprising the bracket coupling the first frame member to the second frame member.

8. The acoustic panel according to claim 7, wherein friction between the first laterally extending projection and the inner surface of the slot in the first frame member hinders removal of the bracket from the first frame member, and wherein friction between the second laterally extending projection and the inner surface of the slot in the second frame member hinders removal of the bracket from the second frame member.

9. The acoustic panel according to claim 7, wherein the first laterally extending projection includes a sharp edge that engages the inner surface of the slot in first frame member, and wherein the second laterally extending projection includes a sharp edge that engages the inner surface of the slot in the second frame.

10. The acoustic panel according to claim 7, wherein the bracket includes a bent metal strip.

11. The acoustic panel according to claim 10, wherein the first and second laterally extending projections are bent outward from a surface of the metal strip.

12. The acoustic panel according to claim 11, wherein the first and second laterally extending projections protrude from a side edge of the metal strip.

13. The acoustic panel according to claim 7, wherein the first and second frame members are formed of a first material and the bracket is formed of a second material, and wherein the first material is softer than the second material.

14. The acoustic panel according to claim 1, wherein the acoustic panel has a noise reduction coefficient of at least 0.7, e.g., at least 0.8, e.g., at least 0.85.

15. The acoustic panel according to claim 1, wherein a surface of the acoustic panel has a light reflectance of at least 75%, e.g., at least 80%, e.g., about 90%.

16. An acoustic panel comprising:

a panel body, the panel body including an upper surface, a lower surface, and a side edge;

a perimeter frame extending around the side edge of the panel body, the perimeter frame including a plurality of frame members comprising a first frame member and a second frame member;

a first adhesive bonding a first portion of an inner surface of the first frame member to the side edge of the panel body; and one or more of (i) a second adhesive bonding a second portion of the inner surface of the first frame member to the side edge of the panel body, the second adhesive having a substantially reduced working time compared to the first adhesive; and (ii) a bracket coupling the first frame member to the second frame member, the bracket comprising:

a first portion that is received in a slot in the first frame member, the first portion including a first laterally extending projection that engages an inner surface of the slot in the first frame member so as to hinder removal of the bracket from the first frame member, and a second portion that is received in a slot in the second frame member, the second portion including a second laterally extending projection that engages an inner surface of the slot in the second frame member so as to hinder removal of the bracket from the second frame member, wherein each of the frame members includes:

an upper arm that covers a portion of the upper surface of the panel body, and a side arm that forms the inner surface that is bonded to the side edge of the panel body.

17. The acoustic panel according to claim 1, wherein the panel body comprises fiberglass.

18. The acoustic panel according to claim 1, wherein the panel body has a noise reduction coefficient ("NRC") value of at least 0.5, e.g., at least 0.7, at least 0.8, or at least 0.85.

19. The acoustic panel according to claim 1, wherein the first adhesive requires at least one hour from application to achieve 95% of its adhesive strength.

20. A method of manufacturing an acoustic panel according to claim 2, the method comprising:

applying a first adhesive between a side edge of a panel body and an inner surface of a first frame member of a perimeter frame;

applying a second adhesive between the side edge of the panel body and the inner surface of the first frame member, wherein the second adhesive has a substantially reduced working time compared to the first adhesive; and securing the frame members of the perimeter frame around the side edge of the panel body.

21. A method of manufacturing an acoustic panel according to claim 7, the method comprising:

applying a first adhesive between a side edge of a panel body and an inner surface of a first frame member of a perimeter frame;

coupling the first frame member to a second frame member of the perimeter frame using a bracket by inserting a first portion of the bracket into a slot in the first frame and inserting a second portion of the bracket in to a slot in the second frame, wherein the first portion of the bracket includes a first laterally extending projection having a sharp edge that engages an inner surface of the slot in the first frame member so as to hinder removal of the bracket from the first frame member, and the second portion of the bracket includes a second laterally extending projection having a sharp edge that engages an inner surface of the slot in the second frame member so as to hinder removal of the bracket from the second frame member.

* * * * *